US009995184B2

(12) United States Patent
Popp et al.

(10) Patent No.: US 9,995,184 B2
(45) Date of Patent: Jun. 12, 2018

(54) ARRANGEMENT FOR COUPLING TWO COMPONENTS THAT CAN MOVE RELATIVE TO EACH OTHER IN A SWITCHABLE VALVE TRAIN COMPONENT FOR AN INTERNAL COMBUSTION ENGINE

(71) Applicant: Schaeffler Technologies AG & Co. KG, Herzogenaurach (DE)

(72) Inventors: Oliver Popp, Hirschaid (DE); Andreas Biermann, Furth (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 106 days.

(21) Appl. No.: 15/258,266

(22) Filed: Sep. 7, 2016

(65) Prior Publication Data

US 2017/0067375 A1 Mar. 9, 2017

(30) Foreign Application Priority Data

Sep. 9, 2015 (DE) ..... 10 2015 217 222

(51) Int. Cl.

*F01L 1/18* (2006.01)
*F01L 1/46* (2006.01)
*F01L 1/14* (2006.01)

(52) U.S. Cl.

CPC ..... *F01L 1/185* (2013.01); *F01L 1/14* (2013.01); *F01L 1/46* (2013.01); *F01L 2001/186* (2013.01); *F01L 2103/00* (2013.01); *F01L 2105/00* (2013.01)

(58) Field of Classification Search

CPC ..... F01L 2001/186; F01L 1/46
USPC ..... 123/90.39, 90.44
See application file for complete search history.

(56) References Cited

U.S. PATENT DOCUMENTS 5,251,586 A * 10/1993 Koga ..... F01L 1/267 123/90.16
6,755,167 B2 * 6/2004 Krieg ..... F01L 1/08 123/90.16
2007/0039573 A1 * 2/2007 Deierlein ..... F01L 1/185 123/52.1
2008/0149059 A1 * 6/2008 Murphy ..... F01L 1/18 123/90.39
2014/0290608 A1 * 10/2014 Radulescu ..... F01L 1/46 123/90.39
2017/0009610 A1 * 1/2017 Ahmed ..... F01L 1/2405

FOREIGN PATENT DOCUMENTS

DE 102004017103 10/2005

* cited by examiner

*Primary Examiner* — Jorge Leon, Jr.
(74) *Attorney, Agent, or Firm* — Volpe and Koenig, P.C.

(57) ABSTRACT

An arrangement for coupling two components that can move relative to each other in a switchable valve train component for an internal combustion engine is provided, with a coupling element (3) that can be moved for coupling the components with a flattened coupling surface (5) for contacting a corresponding locking contour. The locking contour has recesses (7) in which the coupling element (3) can engage so that it can move in contact with the locking contour for coupling with its coupling surface (5) in a position slightly rotated relative to a predetermined coupling position.

8 Claims, 4 Drawing Sheets

ARRANGEMENT FOR COUPLING TWO COMPONENTS THAT CAN MOVE RELATIVE TO EACH OTHER IN A SWITCHABLE VALVE TRAIN COMPONENT FOR AN INTERNAL COMBUSTION ENGINE

INCORPORATION BY REFERENCE

The following documents are incorporated herein by reference as if fully set forth: German Patent Application No. 102015217222.8, filed Sep. 9, 2015.

FIELD OF THE INVENTION

The invention relates to an arrangement for coupling two components that can move relative to each other in a switchable valve train component for an internal combustion engine.

Such an arrangement is known from DE 10 2004 017 103 A1. This describes a rocker arm that can be switched to different travels for at least one gas exchange valve. The rocker arm includes an outer lever and an inner lever running between these arms and arranged so that it can pivot relative to the outer lever. Here, on a bottom side of a lever in a longitudinal hole there is a slide that can be displaced out from one end of the longitudinal hole for coupling and can be engaged with a top side that is stepped and planar in some sections on a planar bottom side of the other lever. A disadvantage in this configuration is the situation in which, due to slight rotating or tilting of the slide in the longitudinal hole, during coupling it is possible for the slide to become jammed with its top side on the bottom side of the other lever. This can cause increased wear and interruptions in operation or even complete operational failure. A tilting of the slide can definitely be counteracted by an appropriate construction of the coupling element, but this can be realized only with difficulty and is cost-intensive.

SUMMARY

The invention is therefore based on the objective of simplifying and economically forming an arrangement of the type specified above with respect to its construction.

This objective is achieved through one or more features of the invention. Advantageous constructions are described in the claims, the description, and the drawings.

An arrangement for coupling two components that can move relative to each other in a switchable valve train component for an internal combustion engine is provided in which, for coupling the components, a movable coupling element with a flattened coupling surface can be placed in a predetermined coupling position on a corresponding locking contour. Because this has recesses in which the coupling element can engage so that it can move in contact with the locking contour for coupling with its coupling surface in a position slightly rotated relative to the coupling position, jamming of the coupling element on the locking contour is prevented and coupling in the rotated position is enabled. This makes it possible to prevent a complicated and cost-intensive construction of the coupling element.

It is advantageous when the recesses form rounded sections on which the coupling element can be automatically oriented during coupling in the rotated position with its coupling surface in the coupling position. Here, on the rounded sections, the forces acting during operation make it possible for the coupling element to automatically turn back with its coupling surface from the rotated position into the coupling position.

In a preferred construction of the invention, the recesses on the locking contour border a locking surface for contacting the coupling surface of the coupling element in the coupling position. Here, the rounded sections are preferably formed in the transition to the locking surface.

It is also advantageous if the coupling element can be placed flat with a planar coupling surface on a corresponding coplanar locking surface on the locking contour in the parallel coupling position.

Preferably the recesses form slots running in the displacement direction of the coupling element, on which the coupling element slightly overlaps in contact with the locking contour.

The locking contour can be created without cutting in an especially simple way by master forming or shaping, especially by embossing or thermoforming.

In one especially preferred construction of the invention, the arrangement is constructed for coupling outer and inner levers that can be pivoted relative to each other in a rocker arm for a valve train of an internal combustion engine. Here, the outer and inner levers can be coupled by a coupling element that is connected to one of the levers and can be positioned for coupling displaceably on a locking contour formed on the other lever.

The coupling element is here arranged preferably displaceable on the outer lever and can be positioned for coupling on the locking contour formed on the inner lever.

The outer and/or inner levers are made at least partially from sheet metal in sheet metal-processing methods, in particular, by stamping, bending, and thermoforming, using weight-saving and especially economical methods.

The invention can also be used in other switchable cam followers, for example, in switchable roller tappets. A use in switchable support elements for cam followers is also conceivable.

BRIEF DESCRIPTION OF THE DRAWINGS

Other features of the invention are given from the following description and from the drawings in which an embodiment of the invention is shown in simplified form. Shown are.

DETAILED DESCRIPTION OF THE PREFERRED EMBODIMENTS

Figure 1:
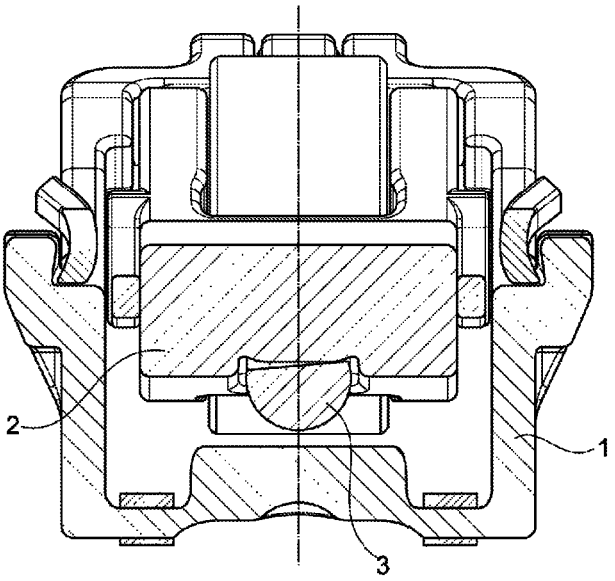
FIG. 1 an arrangement according to the invention in a switchable rocker arm in cross section, FIG. 2 an enlarged section from FIG. 1, FIG. 3 a longitudinal section of the arrangement according to the invention, FIG. 4 an individual view of a coupling element of the arrangement according to the invention, FIG. 5 a perspective partial view of the arrangement according to the invention, FIG. 6 a sectioned individual view of the coupling element of the arrangement according to the invention, FIG. 7 another sectioned individual view of the coupling element of the arrangement according to the invention, and FIG. 8 a perspective view of the switchable rocker arm.
Figure 2:
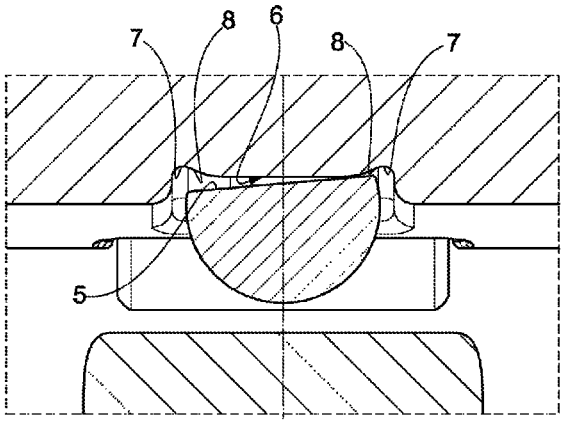
Figure 3:
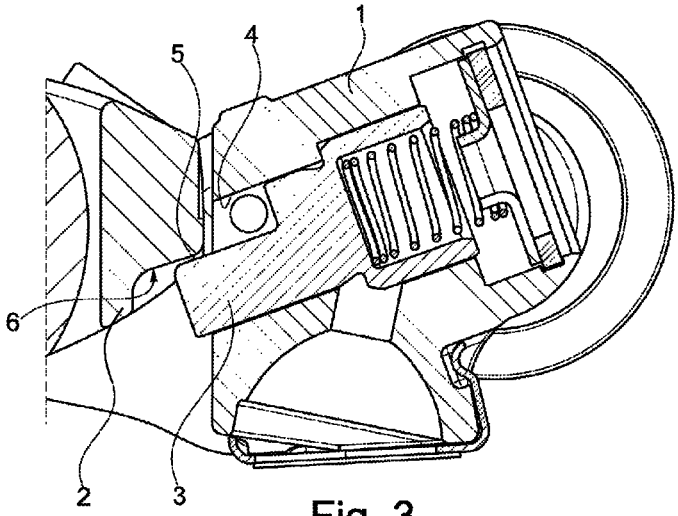

FIGS. 1 to 3 each show a sectional representation of an arrangement according to the invention for coupling two components 1, 2 that can move relative to each other in a switchable valve train component for an internal combustion engine. In this way, the components 1, 2 can be coupled by a coupling element 3 that is connected preferably to a component 1 and can be positioned displaceably on the other component 2. The arrangement is constructed, for example, for coupling outer and inner levers 1, 2 that can be pivoted relative to each other in a switchable rocker arm for a valve train of an internal combustion engine. The outer lever 1 here can be supported so that it can pivot as a so-called primary lever on a support-side lever end region and is in contact at a valve-side lever end region with at least one not-shown gas exchange valve to be actuated. Here, the outer lever 1 surrounds the inner lever 2 at least in some sections, wherein this inner lever is supported on the outer lever 1 so that it can pivot as a so-called secondary lever. The outer and inner levers 1, 2 are formed so that they can pivot in the plane of the figure and can be coupled for switching by a coupling element 3 that can be moved perpendicular to the plane of FIGS. 1 and 2 or into the plane of FIG. 3. The coupling element 3 is oriented with a flattened coupling surface 5 in a predetermined coupling position relative to a corresponding locking contour and can be positioned on this in the pivoting direction for coupling. In the coupled state, a force can be transmitted between the outer and inner levers 1, 2 via the coupling element 3.

Figure 4:
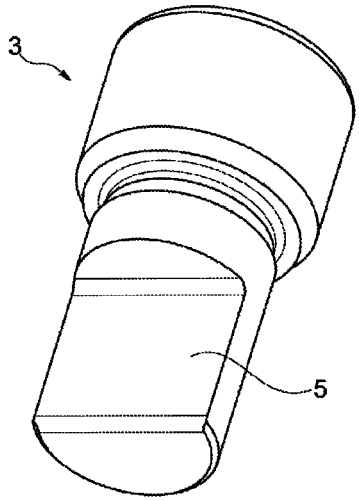

The coupling element 3 is guided as a cylindrical pin so that it can move in a receptacle 4 formed as a hole in the outer lever 1 (FIG. 3). The pin is stepped on a locking-side end section and there forms a planar coupling surface 5 for coupling with the inner lever 2 (FIG. 4). On the inner lever 2 there is, on its bottom side for contacting the coupling element 3, a corresponding locking contour oriented in the pivot direction with recesses 7 running in the displacement direction of the coupling element 3 (FIGS. 1 and 2). The recesses 7 define a locking surface 6 constructed for planar contact of the coupling element 3 coplanar to the coupling surface 5 on the locking contour. For coupling, the coupling element 3 can be moved out from the receptacle 4 under the locking contour and can be positioned with its coupling surface 5 in a parallel coupling position with the coupling surface 5 flat on the coplanar locking surface 6 (FIG. 3).

For coupling, the coupling surface 5 is ideally oriented in a parallel coupling position relative to the locking surface 6, so that the coupling element 3 can be moved with its coupling surface 5 under the locking contour and can be positioned flat on this contour (FIG. 3). FIGS. 1 and 2 show the coupling element 3 during coupling with the position slightly rotated or tilted relative to the parallel coupling position. This is due to the tolerance position of the components, which permits a slight rotating of the coupling element 3 in the receptacle 4 about its longitudinal axis oriented in the displacement direction. For preventing a jamming of the coupling element 3 during coupling in the rotated position, the recesses 7 are formed on the side edges of the locking contour corresponding to the side flanks of the coupling element 3 running in the displacement direction. These define the locking surface 6 on their side edges perpendicular to the displacement direction of the coupling element 3. The recesses 7 here form concave, rounded slots on the side edges of the locking surface 6. They are arranged such that, in the coupling case, the coupling element 3 overlaps slightly on its side flanks with the coupling surface 5 on the side edges of the locking surface 6 and on the recesses 7 bordering this surface. In the slightly rotated position relative to the parallel coupling position, the coupling element 3 can engage with its overlapping side flanks in the corresponding recess 7, wherein the coupling element 3 with the side flank engaging in the recesses 7 can be moved along this flank for coupling. In FIGS. 1 and 2, the coupling element 3 is slightly rotated counterclockwise relative to the parallel coupling position, so that it engages with its right side flank, in the picture, in the corresponding recess 7 arranged on the right side edge of the locking surface. If, in contrast, for coupling the coupling element 3 is rotated slightly in the opposite direction, i.e., clockwise, relative to the parallel coupling position, it can engage accordingly with its side flank arranged on the left, in the picture, in the corresponding recess 7 bordering it on the left side edge of the locking surface 6.

Figure 5:
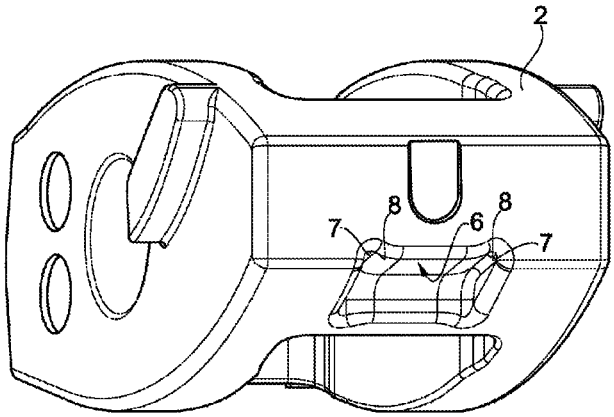

In the transition to the locking surface, the recesses 7 on the locking contour form convex rounded sections 8. These sections and the recesses 7 extend with the locking surface 6 corresponding to the coupling surface 5 continuously in the displacement direction of the coupling element 3 (FIGS. 2 and 5). For coupling in the rotated position, the coupling element 3 is oriented with its coupling surface 5 in contact with the rounded sections 8 in the parallel coupling position to the locking surface 6.

In this way, the coupling element 3 can engage displaceably in the rotated state depending on the direction or the rotating with the corresponding side flank intersecting the coupling plane of the locking surface 6 in the recesses 7 (FIG. 2). Jamming is prevented. At the rounded sections 8, the coupling element 3 with each side flank of the coupling surface 5 can roll under loading for the force transmission and here automatically orient itself with its coupling surface 5 parallel again to the locking surface 6.

Figure 6:
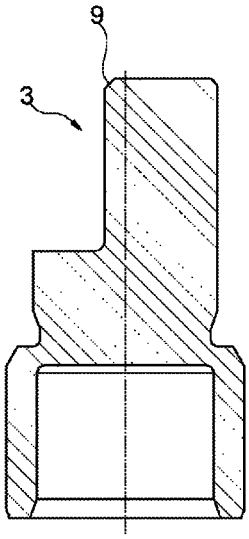
Figure 7:
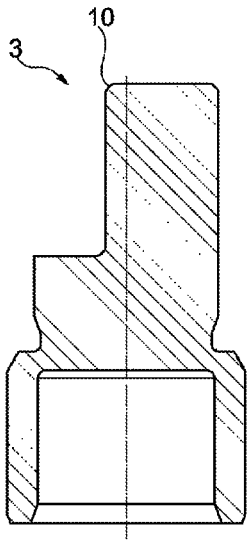

FIG. 7 shows an individual view of the coupling element 3 with its planar coupling surface 5 and the edge that borders this on the end side and is formed with a continuous, simple straight bevel 9 (FIG. 6) or a simple rounded section 10 (FIG. 7). Bevel 9 and rounded section 10 can each be produced simply in one processing step with the coupling surface 5.

In the coupled state of the outer and inner levers 1, 2, by the coupling element 3 connecting to the locking surface 6, a force or a cam travel movement can be transmitted from a cam roller arranged on the inner lever 2 to the outer lever 1 (FIG. 1). The cam roller here overlaps the inner lever 2 on the lever top side and can be driven there by a not-shown camshaft. In the decoupled state, when the coupling element 3 is in the state retracted completely into the receptacle 4 on the outer lever 1, in contrast the inner lever 2 can be pivoted toward the lever bottom side opposite the outer lever 1.

Figure 8:
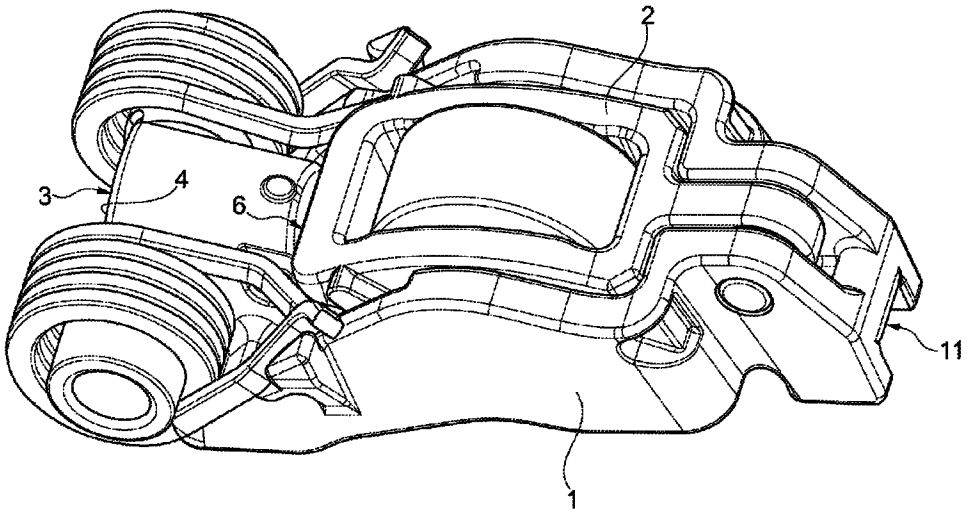

FIG. 8 shows the rocker arm in an overall view. The outer lever 1 includes two opposing side walls that are parallel at least in some sections and extend in the lever longitudinal direction and are connected to each other on the support-side lever end region by means of a cross web. On the support-side lever end region, the outer lever 1 can be supported on the bottom side of the cross web with a support section on a not-shown hydraulic support element so that it can pivot. The support section is here formed by a dome-shaped contact surface on the bottom side of the outer lever 1 (FIG. 3), on which the support element can engage with a not-shown corresponding support so that it can pivot.

The coupling element 3 can be displaced for switching in the receptacle 4 by applying a pressurized medium. The receptacle 4 is arranged in the cross web on the support-side lever end region of the outer lever 1 and runs in the lever longitudinal direction toward the lever bottom side of the inner lever 2 at a slight angle (FIG. 3). For applying the pressurized medium, an opening is provided on the receptacle, wherein this opening communicates via the dome-shaped contact section with the hydraulic support element.

As the pressurized medium, typically pressurized oil from the engine oil circuit of the internal combustion engine is used.

The inner lever 2 has two parallel opposing side walls that are each opposite each other in parallel on their outer sides in the shown non-pivoted home position of their side walls relative to the outer lever 1 (FIG. 8). Outer and inner levers 1, 2 are pretensioned against each other in the home position by restoring springs, wherein, in this position, they can be coupled with each other by the coupling element 3. Between the side walls of the inner lever 2 is the cam roller, which is supported so that it can rotate on the side walls. These are connected to each other on its lever end region turned toward the support-side lever end region of the outer lever 1 by a cross web on whose bottom side the locking contour oriented in the pivoting direction is formed (FIG. 5).

On its valve-side lever end region, the outer lever 1 is, on the bottom side with a valve support 11, in contact with at least one not-shown gas exchange valve to be actuated in the internal combustion engine. The inner lever 2 is supported on the outer lever 1 by a connection axle on the valve-side lever end region so that it can pivot.

LIST OF REFERENCE NUMBERS

1 Component, outer lever
2 Component, inner lever
3 Coupling element
4 Hole
5 Coupling surface
6 Locking surface
7 Recess
8 Rounded section
9 Bevel
10 Rounded section
11 Valve support

The invention claimed is:

1. An arrangement for coupling two components that move relative to each other in a switchable valve train component for an internal combustion engine, the arrangement comprising a coupling element that is movable for coupling the two components, the coupling element including a flattened coupling surface for contact on a corresponding locking contour, and the locking contour has recesses in which the coupling element is engagable so that the coupling element is movable into contact with the locking contour for coupling with the coupling surface in a position that is rotated relative to a predetermined coupling position, and the recesses form slots that run in a displacement direction of the coupling element which the coupling element overlaps when the coupling element is in contact with the locking contour.

2. The arrangement according to claim 1, wherein the recesses form rounded sections on which the coupling element is automatically oriented for coupling in the rotated position with the coupling surface in the predetermined coupling position.

3. The arrangement according to claim 2, wherein the recesses on the locking contour define a locking surface for contacting the coupling surface and the rounded sections are formed in a transition to the locking surface.

4. The arrangement according to claim 1, wherein the flattened coupling surface of the coupling element is planar, the corresponding locking contour has a corresponding locking surface that is coplanar with said coupling surface, and the coupling surface is placed in a parallel coupling position flat on the locking surface.

5. The arrangement according to claim 1, wherein the locking contour is constructed by master forming or shaping.

6. A switchable rocker arm for a valve train of an internal combustion engine, the switchable rocker arm comprising: an inner lever and an outer lever that are pivotable relative to each other, and a coupling arrangement for coupling the inner lever and the outer lever together, the coupling arrangement comprising a coupling element that is movable for coupling the inner lever to the outer lever, the coupling element including a flattened coupling surface for contact on a corresponding locking contour, and the locking contour has recesses in which the coupling element is engagable so that the coupling element is movable into contact with the locking contour for coupling with the coupling surface in a position that is rotated relative to a predetermined coupling position, and the recesses form slots that run in a displacement direction of the coupling element which the coupling element overlaps when the coupling element is in contact with the locking contour.

7. The switchable rocker arm according to claim 6, wherein the coupling element is arranged to be movable on the outer lever and is arranged for coupling on the locking contour formed on the inner lever.

8. The switchable rocker arm according to claim 7, wherein at least one of the outer or the inner levers are made at least partially from sheet metal.

* * * * *